United States Patent [19]

Landua et al.

[11] Patent Number: 4,744,853

[45] Date of Patent: May 17, 1988

[54] CORE OR SHELL BUNDLING MACHINE

[75] Inventors: Werner Landua; Jürgen Müller, both of Mannheim, Fed. Rep. of Germany

[73] Assignee: Adolf Hottinger Maschinenbau GmbH, Mannheim-Rheinau, Fed. Rep. of Germany

[21] Appl. No.: 887,321

[22] Filed: Jul. 21, 1986

[30] Foreign Application Priority Data

Jul. 23, 1985 [DE] Fed. Rep. of Germany ..... 3526265

[51] Int. Cl.[4] ..... B32B 31/00

[52] U.S. Cl. ..... 156/390; 29/238; 29/460; 156/280; 156/356; 156/360; 156/378; 156/558; 156/578; 164/267; 164/270.1; 164/412

[58] Field of Search ..... 156/280, 390, 356, 558, 156/578, 360, 378; 164/267, 412, 270.1; 29/238, 460

[56] References Cited

U.S. PATENT DOCUMENTS 3,274,679 9/1966 Kennedy ..... 29/460

*Primary Examiner*—John J. Gallagher

*Attorney, Agent, or Firm*—Toren, McGeady & Associates

[57] ABSTRACT

The invention relates to a core or shell bundling machine for the fully automatic assembly of bundles of cores or shells in foundry work, and consists of a removal apparatus for the cores/shells, a pivot apparatus, an adhesive application system, a bundling apparatus and an immersion device.

By means of the machine described in the invention, the cores/shells coming from a core and shell shooting machine are immediately combined or bundled in accordance with the cycle time of a machine of this type.

6 Claims, 4 Drawing Sheets

CORE OR SHELL BUNDLING MACHINE

Figure 1:
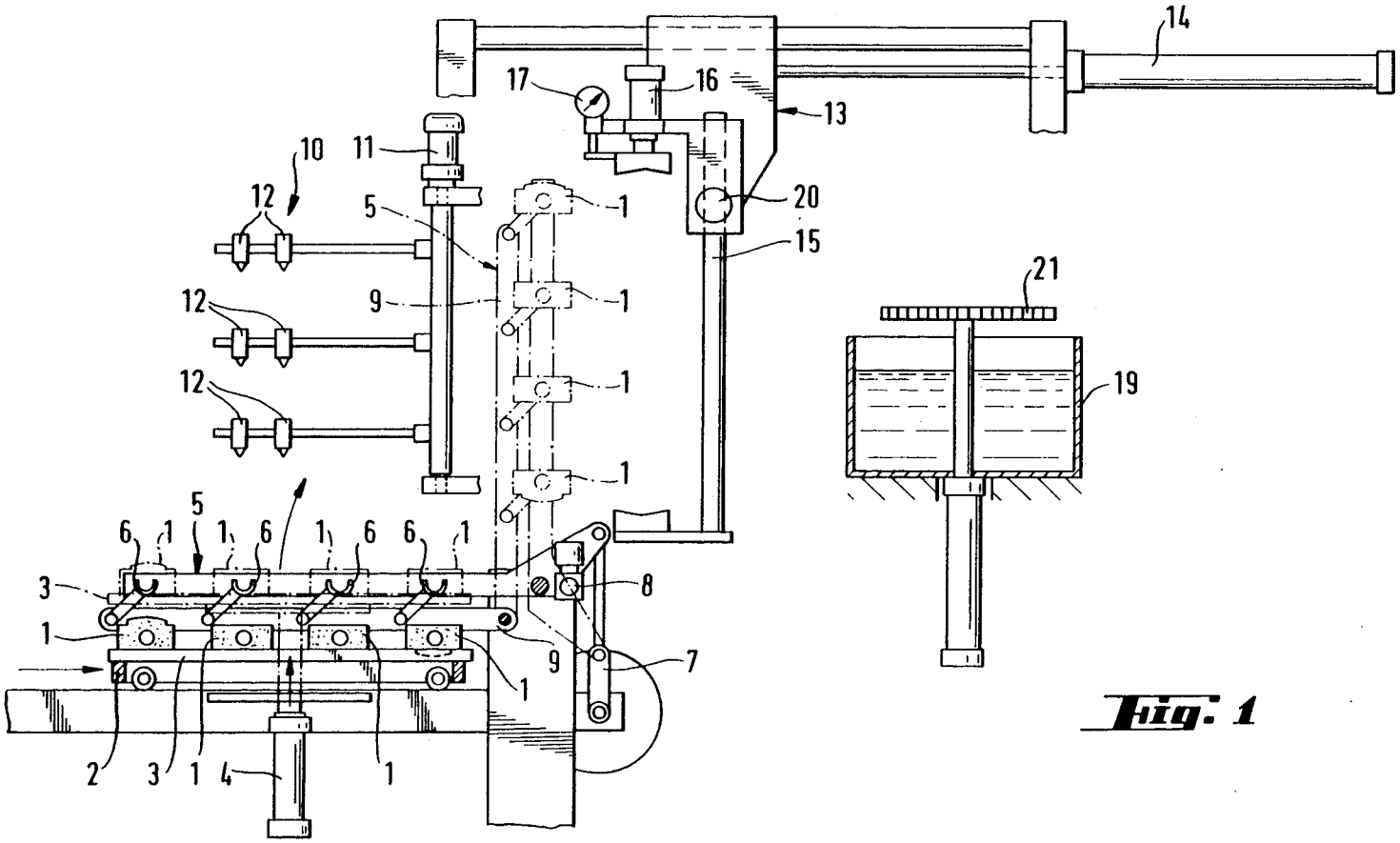

The present invention relates to a core or shell bundling machine.

Hitherto, the assembly of cores or shells has been performed manually. The working procedures are carried out successively. The accuracy of the bundle of cores or shells is dependent on the operator. Moreover, the time taken by manual bundling is substantially longer than the cycle time of the machine, so that several work places have to be set out in order to permit the rate of production which is possible with a high-performance machine. The accuracy of the bundle of cores or shells is likewise dependent on the manual application of adhesive or on the quantity of the adhesive applied or on the reaction time still available for the mutual bonding of the cores/shells.

The object of the present invention is to provide a machine for the bundling of cores or shells, with the aid of which the cores or shells coming from the core or shell shooting machine can immediately be combined or bundled in accordance with the cycle time of the said machine.

The machine according to the invention for the fully automatic assembly of the bundles of cores or shells possesses a removal apparatus for removing the cores or shells from the core or shell shooting machine on a pallet, the cores or shells then being brought into the vertical position with the aid of a pivot apparatus. The cores or shells thus stacked are then provided with adhesive by means of an adhesive application system which can be swung in, and are combined in a bundling apparatus. The bundles of cores or shells can then be moved into an immersion device and provided with a coating. In the normal case the machine is installed directly downstream of a core or shell shooting machine, or it can undertake the bundling as an individual unit detached from the shooting machine.

Because, by means of the bundling machine of the invention, the adhesive is applied simultaneously to all core or shell divisions, because the cores/shells are successively combined, i.e. bundled, by means of a separate lifting apparatus with an attached pressure cylinder, and because the bundle of cores/shells is compressed to the final dimensions by the attached pressure cylinder within the reaction time of the adhesive, automatic and dimensionally accurate assembly is possible, with an adequate, fairly long adhesive reaction time, within the cycle time of a core and shell shooting machine.

The description of a preferred embodiment which follows serves to explain the invention further, in conjunction with the drawings.

Figure 2:
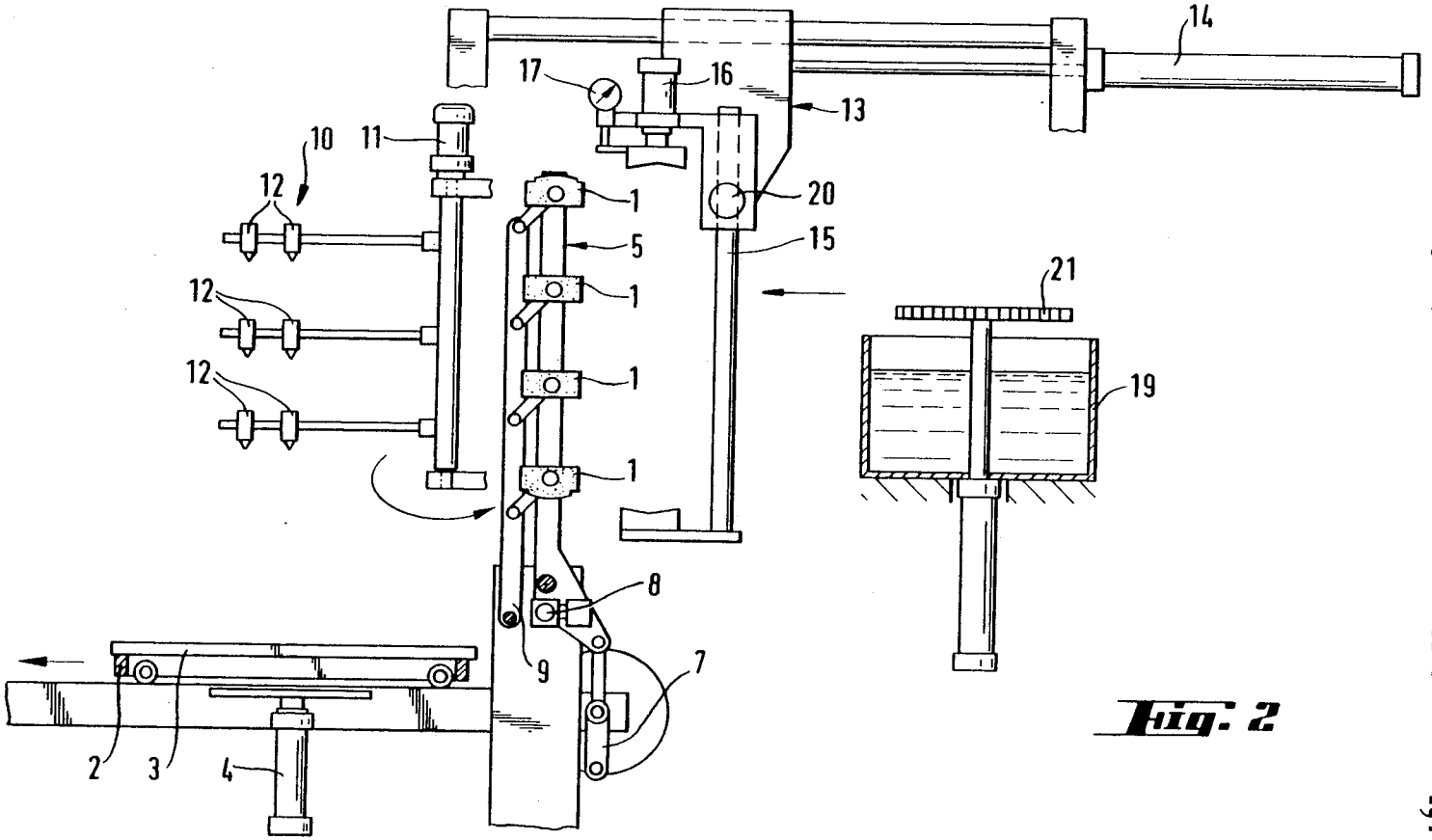
Figure 3:
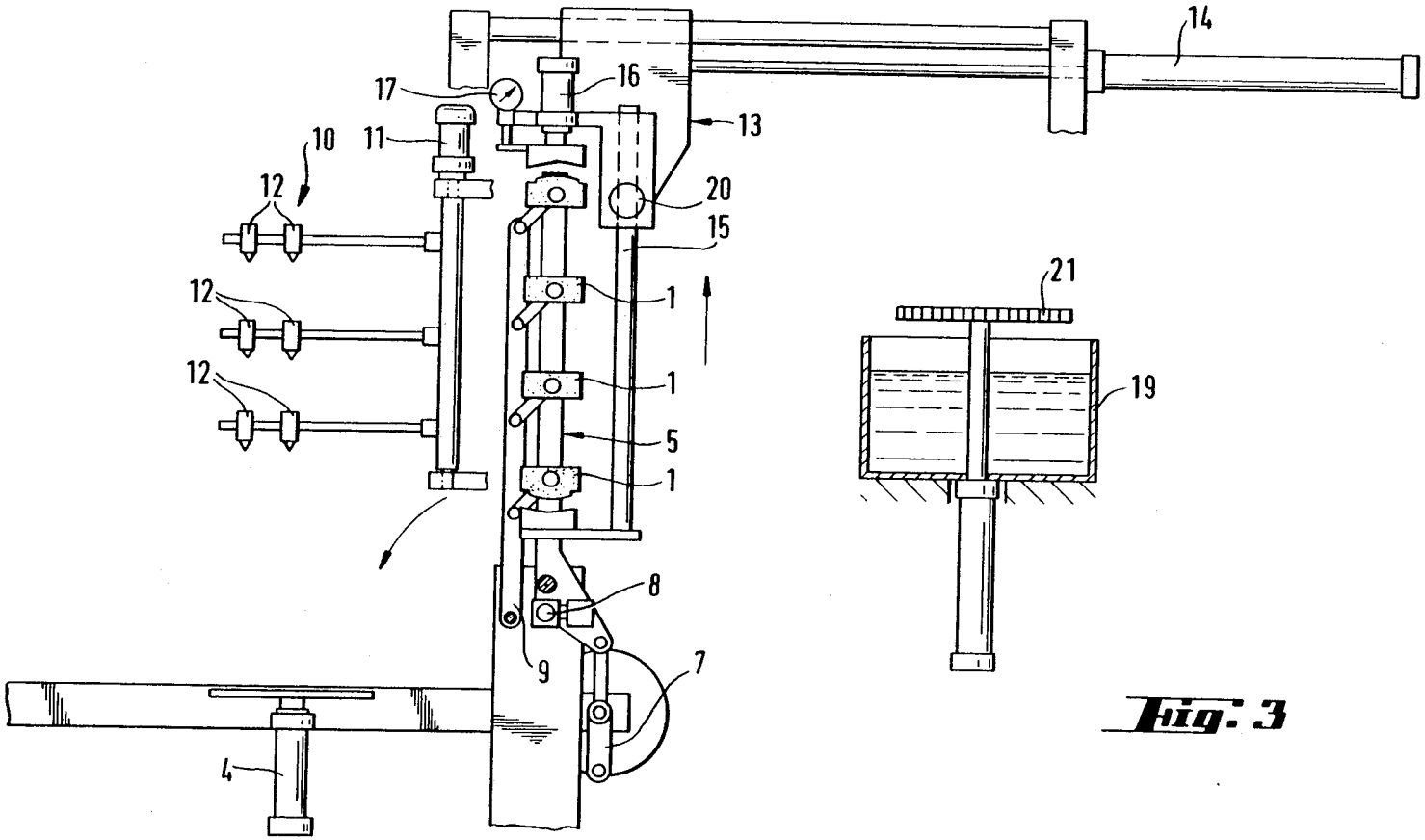
Figure 4:
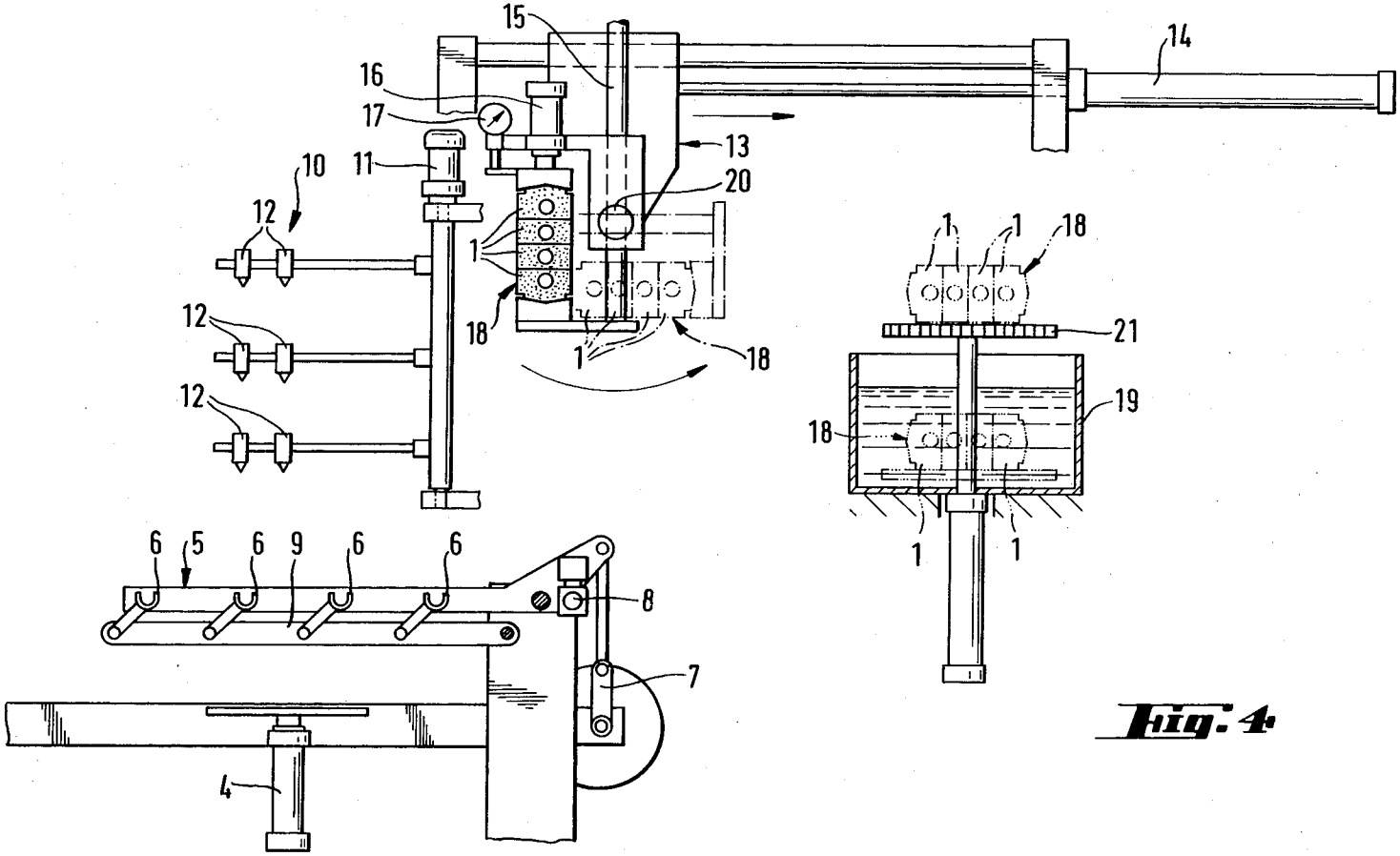

In the drawings:

FIG. 1 is a diagrammatic view, seen from the side, of the removal apparatus for the cores or shells coming from the shooting machine, these cores or shells then being stacked one above the other in a vertical position with the aid of the pivot apparatus, FIG. 2 shows the adhesive application system which can be swung in, and by means of which the adhesive is applied between the cores or shells, FIG. 3 is a diagrammatic view of the bundling apparatus with cores or shells which are now being brought together with the aid of a lifting unit, and FIG. 4 shows the transportation of the bundled cores or shells to the immersion device by means of which the bundle of cores or shells can be introduced into an immersion tank.

According to FIG. 1, the cores/shells 1 are transported from the core and shell shooting machine by means of the removal apparatus 2 with attached removal pallet 3. In the extracted position the removal pallet 3 is lifted by means of a jack 4 into a core/shell pivot apparatus 5. This core/shell pivot apparatus 5 is equipped with lateral clamps 6, which grip the cores/shells laterally from two sides and hence simultaneously straighten them. For this purpose the cores/shells have to be given the appropriate configuration at the gripping positions. The lateral clamps can be adjusted to pre-determined dimensions, irrespective of the length of the cores/shells. The lateral clamps 6 are arranged to be adjustable for this purpose. The adjustment can be performed by the adjuster drive 8 in the case of an automatic plant, or by spacers in a simpler version. The number of lateral clamps 6 installed on the core/shell pivot apparatus 5 depends on the number of cores/shells 1 which can be produced on the core and shell shooting machine per working cycle, or depends on the number of cores/shells which are to be bundled together.

After the cores/shells 1 have been gripped and straightened by the lateral clamps 6 in the core/shell pivot apparatus 5, the cores/shells 1 are simultaneously pivoted upwards through 90 degrees by a pivot drive 7. The effect of the parallel guide 9 by which all the clamps 6 are guided, is that all the cores/shells 1 reach the swung-up position in the same attitude as that in which they were transported by the removal pallet 3 from the core and shell shooting machine. Moreover, correspondingly necessary gaps which are needed for the automatic application of adhesive are still present.

In accordance with FIG. 2, the adhesive application system 10 is swung in between the cores/shells 1 by a pivot drive 11. Subsequently, the adhesive is simultaneously applied to the divisions between the cores/shells by the adhesive application nozzles 12.

The assembly of the cores/shells or the bundling is performed, according to FIG. 3, by the movable core/shell bundling apparatus 13. The bundling apparatus 13 is positioned above the cores/shells 1 by means of the traversing gear 14. The cores/shells 1 are combined, in other words bundled, by the lifting apparatus 15. When the lifting apparatus 15 reaches the individual cores/shells 1, the lateral clamps 6 are individually retracted and the cores/shells 1 thus released for bundling.

When all the cores/shells 1 have been bundled and the lifting apparatus 15 has reached its end position, the bundle 18 of cores/shells is compressed by the pressure cylinder 16 attached to the bundling apparatus 13. As a result of this the adhesive is pressed deeply into the cores/shells 1 and a dimensionally accurate bundle 18 of cores/shells is produced. A separate monitoring apparatus 17 monitors the length of the bundle 18 of cores/shells.

As shown in FIG. 4, the core/shell bundling apparatus 13 moves the bundle 18 of cores/shells, by means of the traversing gear 14, out of the region of the core/shell pivot apparatus 5 over the core/shell immersion tank 19. During the traversing movement, the bundle 18 of cores/shells is swung into the necessary immersion position by an attached pivot drive 20 and is placed on the immersion support 21. After the immersion procedure and the subsequent shaking-off of superfluous blacking (coating) the bundle 18 of cores/shells is transported by another handling unit out of the region of the core/shell bundling apparatus 13.

What is claimed is:

1. A core or shell bundling machine for the fully automatic assembly of bundles of cores or shells in foundry work, comprising a removal apparatus for removing spaced-apart cores or shells from a core and shell shooting machine, a pivot apparatus for lifting the cores or shells from the removal apparatus, the pivot apparatus capable of pivoting the cores or shells from a first position horizontally next to each other to a second position vertically one below the other, an adhesive application system for applying adhesive to the cores or shells when in the second position, a bundling apparatus for combining the cores or shells when in the second position into bundles, and an immersion device, the bundling apparatus including means for moving the bundles to the immersion device, wherein each bundle is being immersed in the immersion device for applying a coating.

2. The machine according to claim 1, wherein the removal apparatus comprises a removal pallet for supporting the cores or shells, and a jack for lifting the removal pallet toward the pivot apparatus.

3. The machine according to claim 2, wherein the pivot apparatus includes lateral clamping means for gripping the cores or shells from two sides, and parallel guide means for aligning the cores or shells, and a first pivot drive for effecting the pivot movement of the pivot apparatus.

4. The machine according to claim 3, wherein the adhesive application system includes a plurality of application nozzles, the nozzles capable of being swung in between the cores or shells by means of a second pivot drive.

5. The machine according to claim 4, wherein the bundling apparatus includes a lifting apparatus for moving the cores or shells together until they contact each other, a pressure cylinder for pressing the cores or shells together, a monitoring apparatus for monitoring the length of each bundle of cores or shells, and a third pivot drive for swinging each bundle into a position for immersion in the immersion device.

6. The machine according to claim 5, wherein the immersion device includes an immersion support member and an immersion tank, the immersion support member capable of lowering each bundle into the immersion tank.

* * * * *